US007462096B2

(12) United States Patent
Montabaur

(10) Patent No.: US 7,462,096 B2
(45) Date of Patent: Dec. 9, 2008

(54) SURFACE-TREATMENT WHEEL

(75) Inventor: Werner Montabaur, Konigswinter (DE)

(73) Assignee: Monti-Werkzeuge GmbH, Bonn (DE)

( * ) Notice: Subject to any disclaimer, the term of this patent is extended or adjusted under 35 U.S.C. 154(b) by 45 days.

(21) Appl. No.: 11/238,080

(22) Filed: Sep. 28, 2005

(65) Prior Publication Data

US 2006/0079163 A1 Apr. 13, 2006

(30) Foreign Application Priority Data

Oct. 9, 2004 (DE) ..... 10 2004 049 235

(51) Int. Cl.
*B23F 21/14* (2006.01)

(52) U.S. Cl. ..... 451/547; 125/15; 451/359; 451/541

(58) Field of Classification Search ..... 12/70, 12/104; 125/13.01, 15; 451/178, 180, 359, 451/541, 546, 547
See application file for complete search history.

(56) References Cited

U.S. PATENT DOCUMENTS 1,156,166 A * 10/1915 Meyers ..... 125/15
3,122,030 A * 2/1964 Metzger ..... 76/112
3,517,463 A * 6/1970 Niemiec ..... 451/542
3,763,601 A * 10/1973 Schwarzkopf et al. ..... 451/542
D266,001 S * 8/1982 Wertheimer ..... D15/140
4,462,382 A * 7/1984 Baron et al. ..... 125/15
4,550,708 A * 11/1985 Roemmele et al. ..... 125/15
5,507,273 A * 4/1996 Chiuminatta et al. ..... 125/13.01
5,787,871 A * 8/1998 Jones et al. ..... 125/15
5,871,005 A * 2/1999 Sueta ..... 125/15
6,309,292 B1 10/2001 Montabaur
6,638,153 B2 * 10/2003 Lee et al. ..... 451/547
6,845,767 B2 * 1/2005 Sakarcan ..... 125/15

* cited by examiner

*Primary Examiner*—Timothy V Eley
(74) *Attorney, Agent, or Firm*—Andrew Wilford

(57) ABSTRACT

A surface-treatment wheel has an inner element rotatable about an axis, and an outer ring fixed rotationally on the inner element, centered on the axis, and formed unitarily with an annular array of radially outwardly projecting teeth defining outwardly open notches, and respective angularly extending webs or ridges in the notches.

6 Claims, 2 Drawing Sheets

Fig. 3
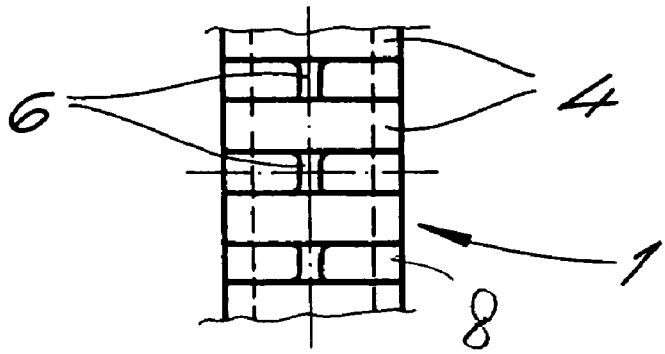
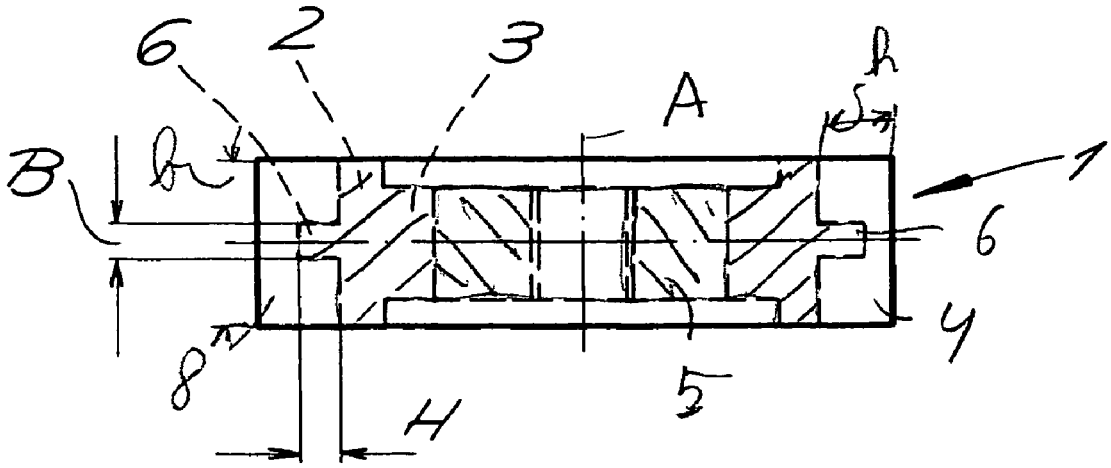
Fig. 4

SURFACE-TREATMENT WHEEL

FIELD OF THE INVENTION

The present invention relates to a surface-treatment wheel. More particularly this invention concerns such a wheel having a plurality of radially projecting solid teeth.

BACKGROUND OF THE INVENTION

In U.S. Pat. No. 6,309,292 a surface-treatment wheel is described intended mainly for use stripping adhesive residue and foil off a lacquered metal surface. It is adapted to be rotated about an axis and has an outer ring unitarily formed of plastic or rubber with an array of identical radially outwardly projecting teeth that can be elastically deformed. This ring is carried on a hub that is fixed to the arbor of a drive unit, for instance a hand-held pneumatic drive, so that a user can press the rotating wheel against a surface to be cleaned and the teeth will rub off any foreign matter on the surface.

In the known system there is a tradeoff between operating speed and efficiency on the one side and tool life on the other. The higher the operating speed, the more efficiently the tool removes material from the surface being cleaned or buffed, but the more likely the teeth are to be abraded or even broken off.

OBJECTS OF THE INVENTION

It is therefore an object of the present invention to provide an improved surface-treatment wheel.

Another object is the provision of such an improved surface-treatment wheel that overcomes the above-given disadvantages, in particular that can be operated at high speed without damage to its teeth.

SUMMARY OF THE INVENTION

A surface-treatment wheel has according to the invention an inner element rotatable about an axis, and an outer ring fixed rotationally on the inner element, centered on the axis, and formed unitarily with an annular array of radially outwardly projecting teeth defining outwardly open notches, and respective angularly extending webs or ridges in the notches.

With the structure of this invention the length of the lever arms formed by the processing teeth is considerably reduced, so that breakage of the processing teeth is surprisingly prevented even if the width of the stabilizing webs is less than the width of the processing teeth. Added to this is the fact that the wear is in this way substantially reduced, and, even taking account of an increase in wear, the outer rim will run true and consequently the toothed rim with the processing teeth is optimized. This applies even in the case of unskilled or improper handling at high rotation speeds. This results in increased service life and erasing or cleaning capacity, without the risk of damage to the surfaces which are being treated.

According to the invention the teeth are substantially identical and have a predetermined radial height and a predetermined axial thickness. The ridges all are substantially identical and have a predetermined radial height shorter than that of the teeth and a predetermined axial thickness shorter than that of the teeth. Thus the teeth will extend axially in both directions and radially outward past the ridges.

These ridges are axially centered in the respective notches. The ridge height is equal to about two-thirds of the tooth height. This tooth height is equal to between 7 mm and 9 mm. The tooth thickness is equal to between one-fifth and two-fifths of the tooth thickness. Thus the ridges normally will not themselves ever touch the workpiece being treated.

The teeth in accordance with the invention have angularly directed planar flank faces defining the notches and the ridges are unitarily joined to the respective teeth at the faces thereof. These flanks extend at an acute angle of about 40° to each other, making the notches V-shaped. This ensures that the ridges or webs stabilize the teeth without interfering with how they function.

BRIEF DESCRIPTION OF THE DRAWING

The above and other objects, features, and advantages will become more readily apparent from the following description, reference being made to the accompanying drawing in which:

FIG. 3 is a view taken in the direction of arrow III of FIG. 2 of the wheel; and FIG. 4 is a diametral section taken along line IV-IV of FIG. 2 through the wheel.

SPECIFIC DESCRIPTION

Figure 1:
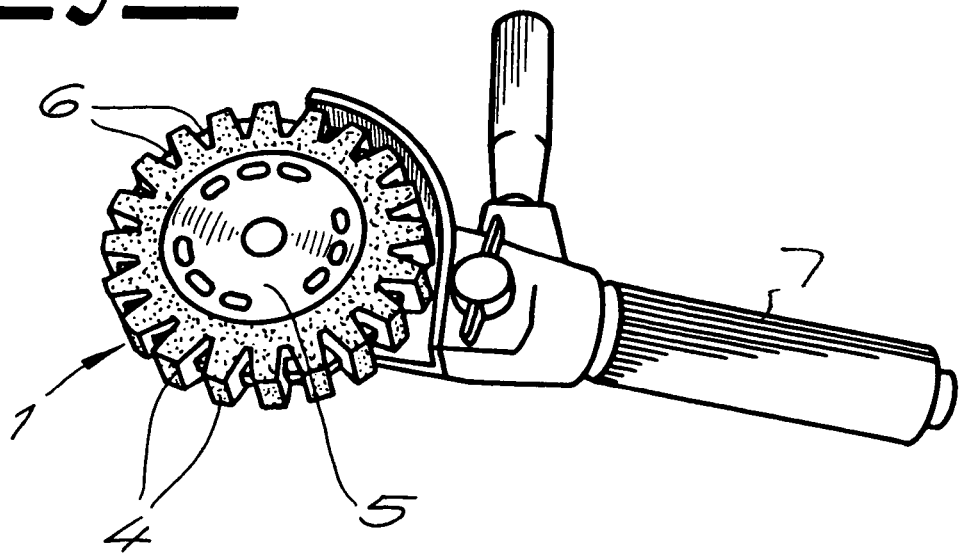
FIG. 1 is a perspective view of the tool of this invention mounted on a pneumatic drive unit.
Figure 2:
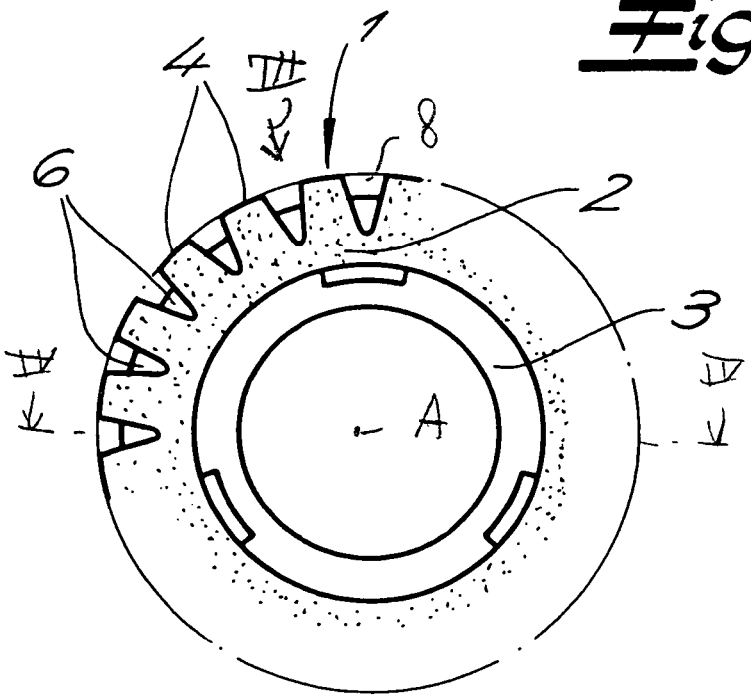
FIG. 2 is a side view of the wheel.

As seen in FIG. 1 a surface-treatment wheel 1 according to the invention is made of a rubber or a rubber-like plastic outer ring 2 rotationally fixed as described in the above-cited patent to an inner ring 3, and carried on a central hub 5. A pneumatic drive unit 7 rotates the wheel 1 about an axis A on which the rings 2 and 3 and hub 5 are centered.

The outer ring 2 is formed unitarily of one piece with an array of radially outwardly projecting teeth 4 extending as shown in FIG. 3 the full axial thickness of the wheel 1 and defining V-shaped outwardly open notches 8. According to the invention a web or ridge 6 of basically rectangular shape (see FIG. 4) extends centrally across each of the notches 8 and is unitarily formed with the respective teeth 4.

The ridges or webs 6 each have a radial height H in the respective notch 8 equal to about ⅔ of a height h of the teeth 4 and an axial thickness B equal to between ⅕ and ⅖ an axial thickness b of the ring 2. Here the height H is equal to 20 mm and the height h to 30 mm. The thickness B is equal to between 7 mm and 9 mm, preferably 8 mm, while the thickness b is equal to 30 mm.

I claim:

1. A surface-treatment wheel comprising:

an inner element rotatable about an axis; and a one-piece annularly continuous outer ring centered on the axis, having a radially inwardly directed circular inner periphery fixed rotationally on the inner element, and formed unitarily entirely of rubber or a rubber-like plastic with an annular array of radially outwardly projecting teeth having angularly directed and generally radially extending flank faces defining outwardly open notches, the teeth being substantially identical and each having a predetermined radial tooth height and a predetermined axial tooth thickness, the ring being annularly continuous radially inward of the notches and radially outward of the inner periphery, and respective ridges in the notches radially outside the inner periphery, extending angularly between and unitarily joined to the faces of the respective teeth, and all being substantially identical and having a predetermined radial ridge height shorter than the tooth height and a predetermined axial ridge thickness shorter than the tooth thickness.

2. The surface-treatment wheel defined in claim 1 wherein the ridges are axially centered in the respective notches.

3. The surface-treatment wheel defined in claim 1 wherein the ridge height is equal to about two-thirds of the tooth height.

4. The surface-treatment wheel defined in claim 3 wherein the tooth height is equal to between 7 mm and 9 mm.

5. The surface-treatment wheel defined in claim 1 wherein the ridge thickness is equal to between one-fifth and two-fifths of the tooth thickness.

6. The surface-treatment wheel defined in claim 1 wherein the ridges are of rectangular section and extend continuously between the respective flank faces.

* * * * *